US005864971A

United States Patent [19]

Jones

[11] Patent Number: 5,864,971

[45] Date of Patent: Feb. 2, 1999

[54] DEBRIS REMOVING APPARATUS

[76] Inventor: Norton Thomas Jones, 47 Cowra St., Tanah Merah, Queensland 4128, Australia

[21] Appl. No.: 804,643

[22] Filed: Feb. 25, 1997

[30] Foreign Application Priority Data

Feb. 27, 1996 [AU] Australia ..... PN8371

[51] Int. Cl.[6] ..... E02F 3/00

[52] U.S. Cl. ..... 37/410; 37/420; 37/428; 37/435; 172/684.5; 414/526

[58] Field of Search ..... 37/341, 379, 411, 37/415, 416, 417, 420, 142.5, 427, 428, 429, 430, 435, 437; 404/85, 118; 172/799.5, 684.5; 414/402, 403, 487, 491, 526

[56] References Cited

U.S. PATENT DOCUMENTS

| | | | |
|---|---|---|---|
| 2,481,679 | 9/1949 | Miller et al. | 404/90 |
| 3,474,548 | 10/1969 | Miller | 37/426 |
| 3,520,432 | 7/1970 | Muotka et al. | 37/304 X |
| 3,738,028 | 6/1973 | Reinhardt | 37/416 |
| 4,015,348 | 4/1977 | Gee et al. | 37/411 X |
| 4,197,049 | 4/1980 | Stedman et al. | 37/420 X |
| 4,389,800 | 6/1983 | Goby | 37/415 |
| 4,864,748 | 9/1989 | Boyer | 37/142.5 |
| 5,097,610 | 3/1992 | Bishop | 37/142.5 |
| 5,129,169 | 7/1992 | Aubichon | 37/403 X |
| 5,273,375 | 12/1993 | Plourde | 37/403 X |
| 5,344,254 | 9/1994 | Sartian | 404/104 |

*Primary Examiner*—Christopher J. Novosad
*Attorney, Agent, or Firm*—Panitch Schwarze Jacobs & Nadel, P.C.

[57] ABSTRACT

An earthmoving apparatus collects windrows of loose material left behind during roadmaking via a ground tracking pick up head and without damaging the ground surface. The apparatus can be used for removing other types of loose material from the ground without damage to the ground.

6 Claims, 4 Drawing Sheets

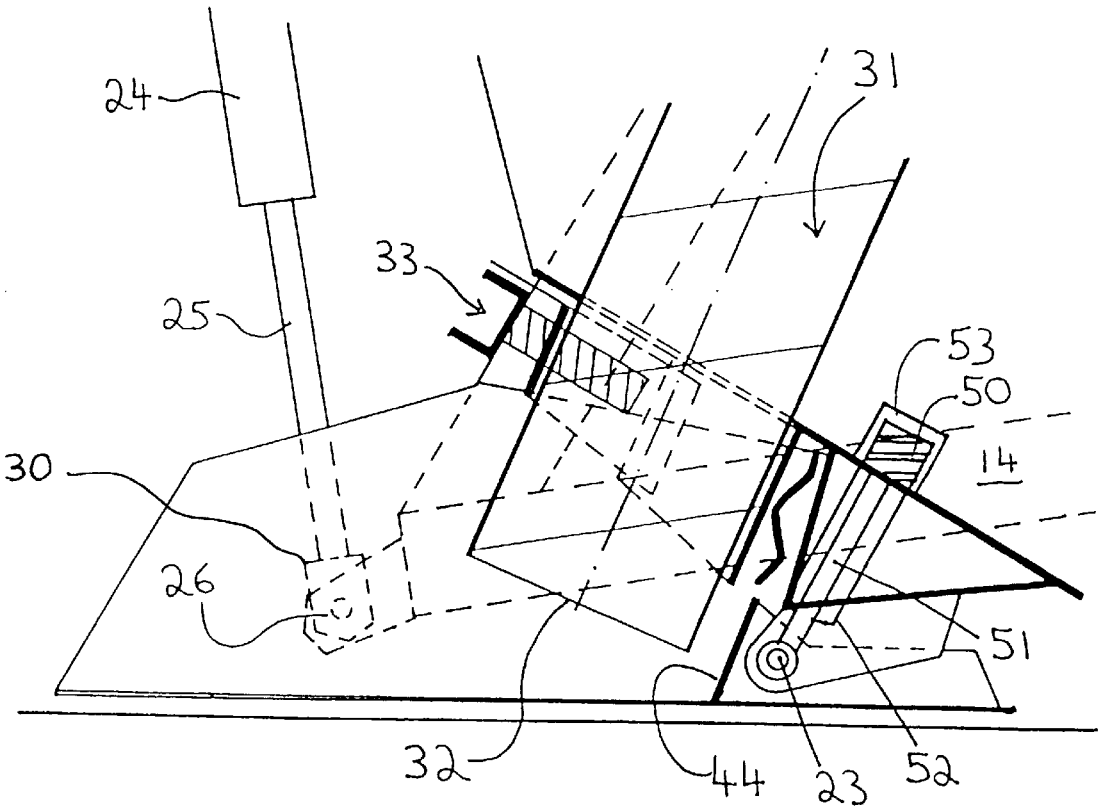
Fig. 4
Fig. 5
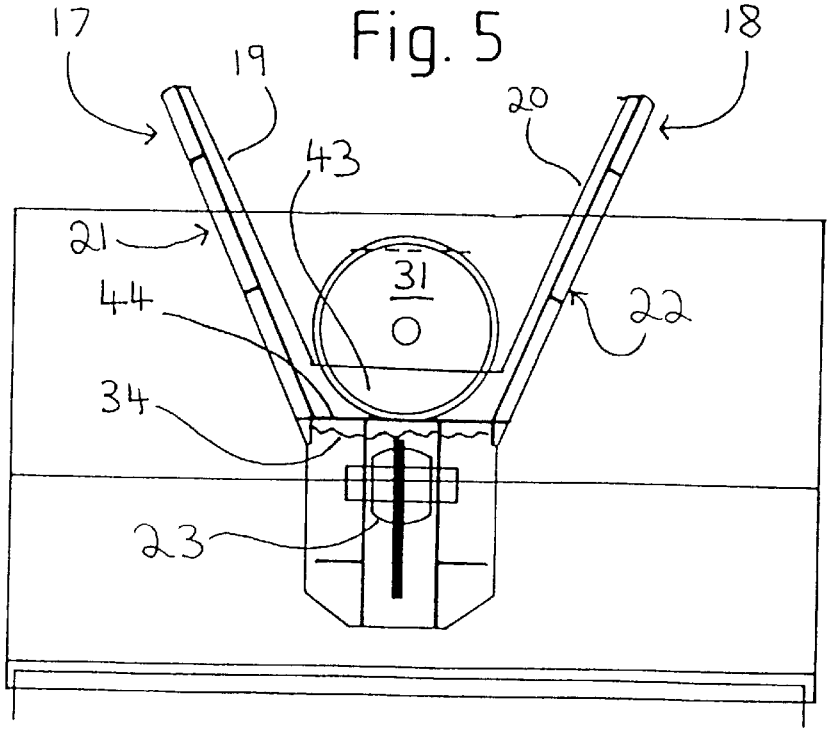

DEBRIS REMOVING APPARATUS

BACKGROUND OF THE INVENTION

This invention relates to a debris removing apparatus and particularly relates to an earth working apparatus for picking up windrows of loose material on a ground surface, such as a road surface.

When pavements such as roads, airports, industrial hardstandings, and the like, are constructed out of gravel, crushed rock, or other quarry products, graders are used to trim each layer to the required level, shape and texture.

Any surplus material is cut off by the grader and left in windrows, that is, rows of loose material sitting on top of the finished surface.

Currently, the task of removing this material is performed by either small elevating scrapers, or by front-end loaders. Neither of these existing machines are efficient since they spread and spill the loose material, necessitating the expensive and tedious repetition of the grading and grade checking operations. Also, as scrapers and front-end loaders are primarily designed for other tasks, these machines often cut and damage the finished surface which can change the level, shape and texture of the surface.

I have therefore designed an apparatus which can pick up loose debris such as the windrows of loose material on a ground surface and which can eliminate, or at least reduce, the disadvantages found with the use of scrapers and front-end loaders.

My apparatus can be used in other applications as well, such as for general removal of loose debris on a factory floor or other ground surface.

SUMMARY OF THE INVENTION

It is therefore an object of the invention to provide an apparatus which may overcome the abovementioned disadvantages or provide the public with a useful or commercial choice.

In one form, the invention resides in an apparatus for picking up loose material from a ground surface, the apparatus having a pick-up head with a bottom wall adapted to slide along the ground surface, a collection area to hold the loose material collected from the ground surface, an inlet area to scrape up the loose material as the pick-up head moves along the ground surface, material removing means to remove loose material in the collection area, and tracking means to allow the pick-up head to track the ground surface as it moves therealong.

The pick-up head may form part of a larger wheeled apparatus which can be towed behind a vehicle, or can be part of a powered vehicle. For instance the apparatus can be self propelled using hub motors on the back wheels.

By having the pick-up head able to track the ground surface, it is able to efficiently pick up the windrows of gravel, crushed rock, or other loose material without digging in or damaging the ground surface itself.

The bottom wall of the pick-up head may be flat and may be of a size to allow it to act as a skid-shoe, that is, having a reduced ability of cutting the finished surface in any way and only capable of sliding over the surface. The bottom wall preferably directly contacts and slides along the ground surface, although there may be a requirement to provide slides on the bottom wall to assist in this function.

The pick up head can comprise a pair of forwardly extending outwardly diverging arm members which can slide along the ground as the apparatus moves, and which function to guide loose material towards the collection area.

The arm members can converge to a web portion (which can be in the form of a steel plate), with the web portion forming part of the collection area.

The bottom wall of the pick up head can comprise the bottom wall of the diverging arm members. That is, the bottom wall can be defined by the bottom of each arm member.

The collection area is preferably part of the pick-up head. The collection area may be located behind the inlet area. Suitably, the collection area is defined by upstanding side walls extending from the bottom wall. For instance, the collection area may be defined by a pair of opposed side walls and a rear wall extending upwardly from the bottom wall.

The inlet area may extend from a leading part of the bottom wall. The inlet area can comprise a leading edge of the bottom wall which can be tapered to facilitate sliding of the bottom wall along the ground surface and minimise any damage to the ground surface.

If the pick up head includes the forwardly extending diverging arm members, the inlet area can include an inner side edge of each arm member and a forward part of the connecting web portion.

The side walls defining part of the collection area may extend upwardly from adjacent the inlet area such that, for instance, windrows are scraped from the inlet and are held between the side walls and the rear wall of the pick-up head.

The pick-up head may be pivotally mounted relative to the remainder of the apparatus to facilitate its tracking ability along the ground surface. The pivot mounting may be adjacent a rear portion of the pivot head and spaced from the inlet area.

The pick-up head may be moveable between a raised and lowered position. A ram, such as an hydraulic or pneumatic ram, may be provided to assist in the raising and lowering action. If a ram is provided, it may have a floating position such that the ram does not exert any pressure on the pick-up head, thereby facilitating in the tracking ability of the pick-up head. An inbetween valve can be provided to provide a small upward lift to the pick up head.

Springs can also be used for this purpose.

It may be desirable to remove the material from the collection area and into a larger bulk bin, or somewhere else. Thus, it may be desirable to have some form of material removing means which can intermittently, or continuously, remove material from the collection area. For instance, this may be in the form of an auger, a flight of elevators, or any other type of convenient mechanism or means to remove material from the collection area.

BRIEF DESCRIPTION OF THE SEVERAL VIEWS OF THE DRAWINGS

An embodiment of the invention will be described with reference to the following drawings in which

FIG. 4 illustrates a close up side elevation view of the pick-up head.

FIG. 5 illustrates a plan view of the pick up head of FIG. 4.

DETAILED DESCRIPTION OF THE INVENTION

Figure 1:
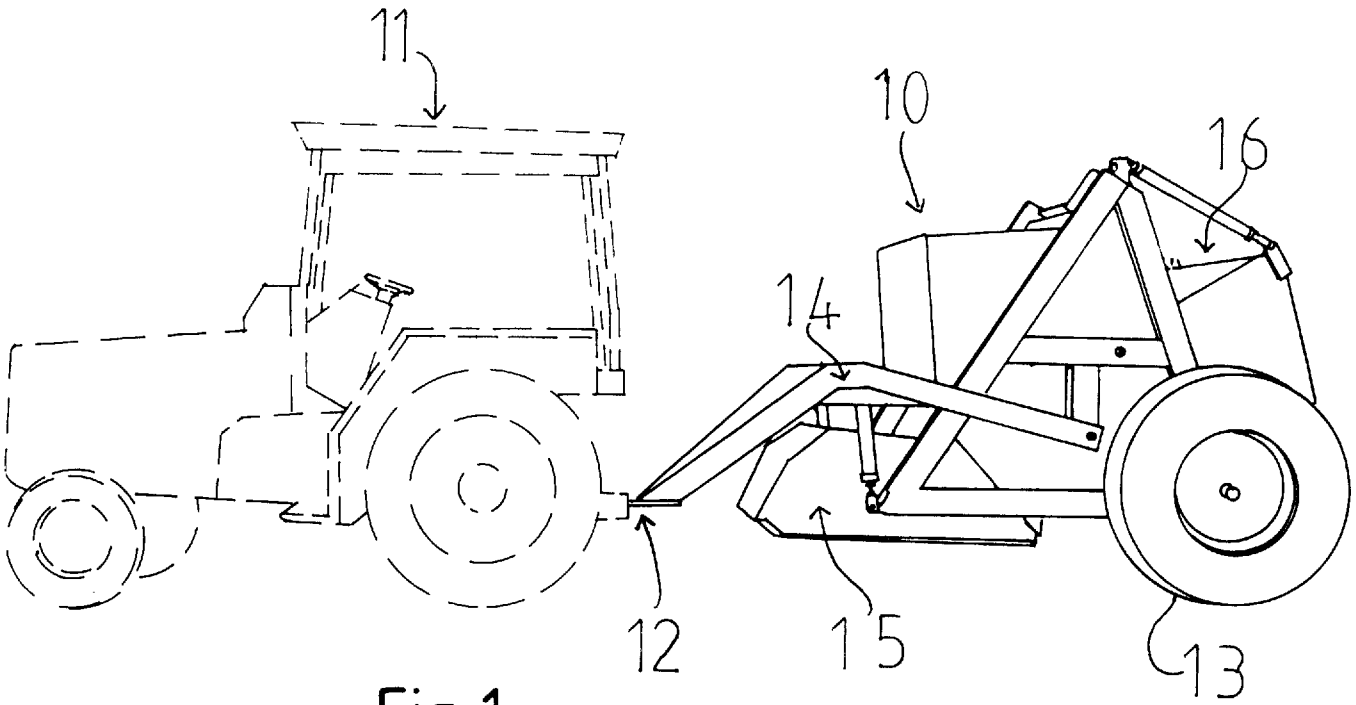
FIG. 1 illustrates a side elevation view of an apparatus according to an embodiment of the invention.
Figure 2:
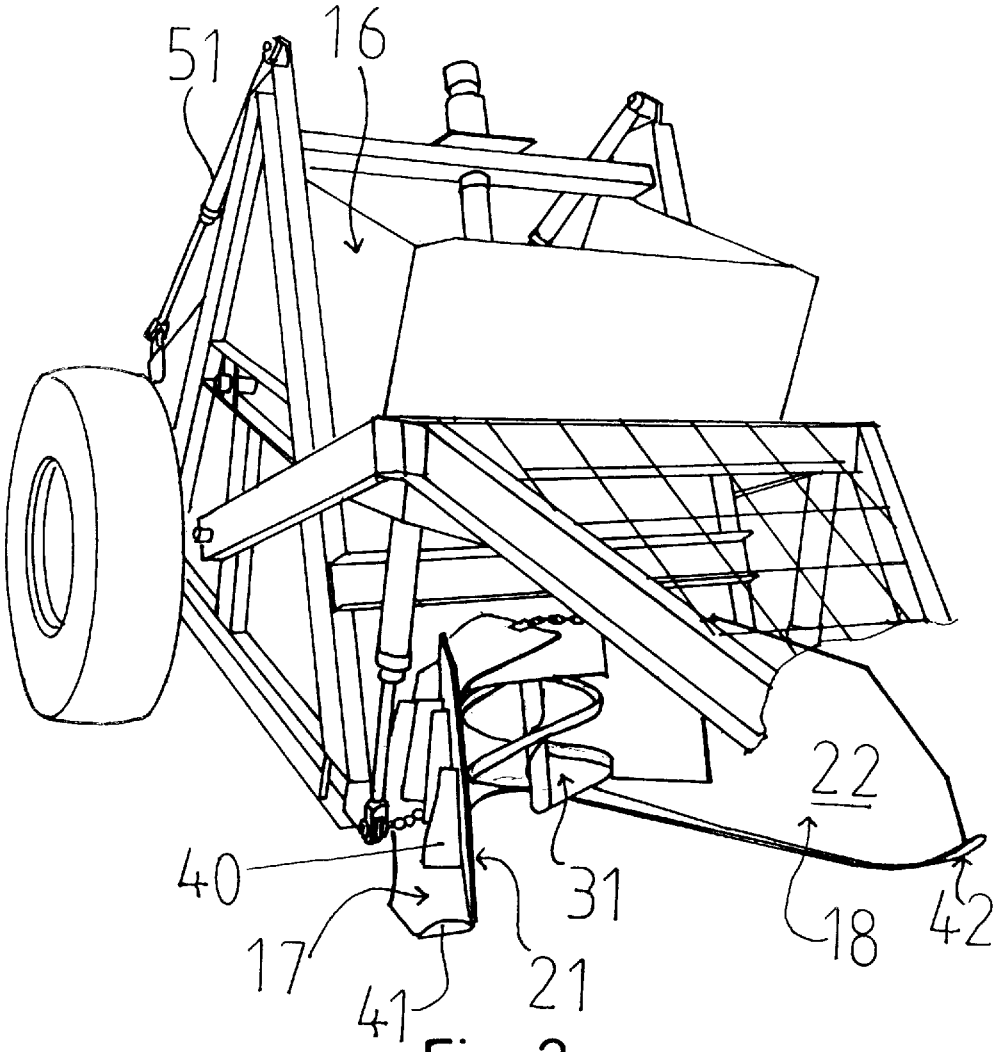
FIG. 2 illustrates a front perspective forward view of the apparatus of FIG. 1.
Figure 3:
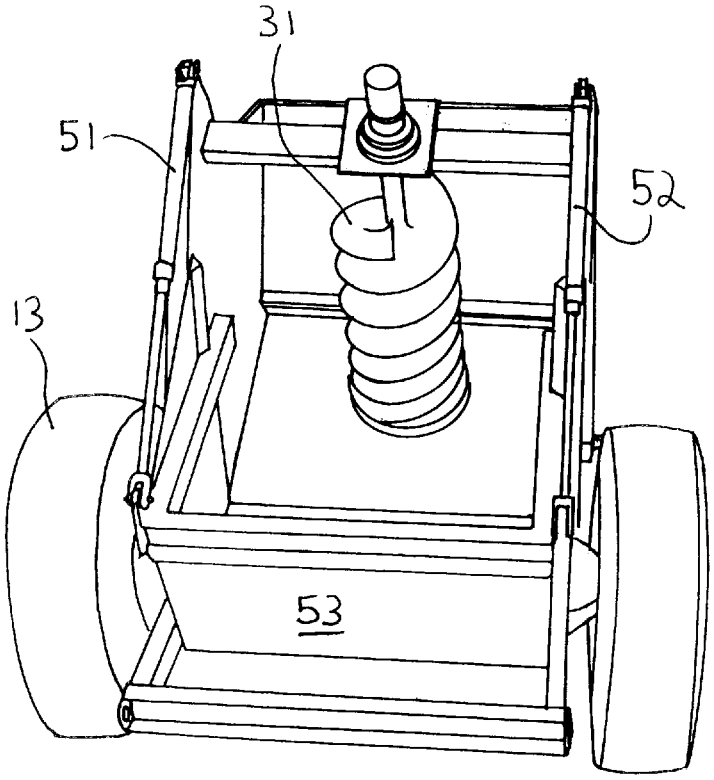
FIG. 3 illustrates a rear perspective plan view of the apparatus of FIG. 1.

Referring to the drawings, and initially to FIGS. 1–3, there is shown an apparatus 10 for picking up windrows of loose material on the road surface. The apparatus can be towed behind a vehicle 11 through a typical hitch joint 12. Apparatus 10 is portable in a sense that it has rear wheels 13 and a support frame 14.

Apparatus 10 broadly consists of a supporting framework 14, a lower pick-up head 15, and an upper and rearward dump bin 16 which holds the loose material collected by the pick-up head.

Referring in greater detail to pick-up head 15, the pick-up head in the embodiment consists of a pair of forwardly extending and outwardly diverging arm members 17, 18. The arm members are formed from plate steel and have a flat bottom wall 19, 20 and an upwardly extending side wall 21, 22. The bottom wall of each arm member is in the form of a skid shoe as best illustrated in FIG. 2. Strengthening plates 40 are provided to prevent the side walls from bending under conditions of load. The forwardmost portion of each arm member has a turned-up lip 41, 42 to allow the arm members to slide along the ground without the tips gouging into the ground.

The arm members function to collect and guide loose material towards the converging back portion of the arm members. In this converging back portion, the arm members are connected by a flat web portion 43 (best illustrated in FIG. 5). The web portion collects the loose material on top of it.

The inlet area of the pick-up head can be seen as comprising the inner portions of each arm member 17, 18 and the front edge of web portion 43.

The web portion 43 forms part of a collection area. The collection area extends at a rear portion of the arm members and it is in this portion that the loose material collects as the apparatus moves along the ground. The collection area is best illustrated in FIG. 5 and can be defined by web portion 43, a rear wall 44, and portions of the inside area of arm members 17, 18.

Located in this area is a material removing means in the form of an auger 31. Auger 31 functions to pick up the loose material collected in the collection area and to auger it up into dump bin 16.

The arm members and therefore the pick-up head rests on the ground surface and is held there by its own weight plus a proportion of the weight of the entire apparatus.

Pick-up head 15 is pivoted to the remainder of the apparatus through a ball joint 23 which is positioned at a rear portion of pick-up head 15 and spaced from the inlet. Ball joint 23 allows the pick-up head to pivot up and down (that is, about a horizontal axis) and also allows the pick-up head to pivot from side to side (that is, a rocking type motion).

The two degrees of movement of the pick-up head allows it to accurately track the ground surface to pick up the windrows of loose material.

To raise and lower pick-up head 15, there is provided a hydraulic ram 24 having a piston arm 25 which is pivotly attached at 26 to part of the apparatus to which ball joint 23 is also attached to. Thus, raising of ram 24 will cause pick-up head 15 to be raised above the ground surface and this can be seen as a transport, travelling or dumping position. Ram 24 can also lower the pick-up head to the ground surface such that the pick-up head adopts its working or use position.

To ensure that ram 24 does not dampen or unduly affect the tracking ability of pick-up head 15, ram 24 has a floating position where it does not exert any pressure and where the hydraulic oil can move freely to each side of the piston. In the floating position, up and down movement of pick-up head 15 will merely cause piston arm 25 to move in and out of its ram body without the ram damping or preventing any tracking of movement.

In addition, the hydraulic valve which controls ram 24 will be supplemented by additional hydraulic valves which can be in the form of a release valve linked to a spool valve and inserted in the circuit between the main control valve and the ram. This additional equipment will apply a known value to the lift side of the ram, for instance to carry a proportion of the mechanical weight on the drive wheels, but still allowing the pick-up head to track the ground surface.

FIG. 4 shows ram 24 attached through piston arm 25 to support member 30 and it can be seen that raising and lowering of the ram will cause support member 30 to also be raised and lowered which in turn will raise and lower pick-up head 15. Stop members (not shown) can be provided to prevent undue forward pivoting of the pick-up head around ball joint 23 upon raising of ram 24. A small link chain extends from frame 14 and to each arm member 17, 18 (see FIG. 2). The chain prevents swaying and droop of the pick-up head.

To allow the pick-up head to track the ground surface, ball joint 23 is attached to frame 14 via a spring loaded mechanism which consists of a coil spring 50, a shaft 51, a bush 52 and a spring retainer 53. This allows the pick-up head to adopt vertical movement while still ensuring that it remains in good ground contact with the ground.

The loose material which is pushed into pick-up head 15 is removed from the collection area by an auger 31. It should, however, be appreciated that the auger is only one preferred manner by which the loose material can be removed. Auger 31 has an auger screw located within a tubular housing with the lower portion of the tubular housing 32 extending into pick-up head 15 (see FIG. 4). In the embodiment, a recoil spring 33 is provided to kick back should the auger screw become stuck and therefore the recoil spring facilitates clearing of any obstructions in the auger.

A rubber conveyor/belting member 34 is fitted to provide flexibility for the pick-up head to oscillate between the steel frame of the apparatus and the throat area 35 of the auger.

Auger 31 collects the loose material and passes it through tubular housing 32 into dump bin 16. FIG. 3 shows the dump bin from the top view. When dump bin 16 is full, it can be emptied by activating ram 51, 52. These rams function to pivot upwardly a rear portion 53 of the dump bin effectively splitting the dump bin in half. The collected material then falls through the opening formed in the bottom of the dump bin and onto the ground.

Pick-up head 15 is attached to the frame of the apparatus at a single point, being the large and sturdy ball joint 23. The ball joint permits the pick-up head to track the surface in a vertical plane and a horizontal plane and independently of the remainder of the apparatus. That is, should the apparatus change its cross-slope posture relative to the finished surface, for instance, due to a wheel climbing onto concrete kerbing or a wheel dropping over the crown of a road, the pick-up head continues to track the surface quite independently.

In another manner of speaking, the pick up head while being attached to the rest of the apparatus, has no fixed relationship to it and can therefore efficiently track the ground.

It should be appreciated that various other changes and modifications may be made to the embodiments described without departing from the spirit and scope of the invention.

I claim:

1. An apparatus having a pick-up head for picking up loose material from a ground surface, the pick-up head comprising:

a bottom wall bordering an inlet area of the pick-up head, the bottom wall being adapted to slide the pick-up head along the ground surface and the inlet area being adapted to receive scraped up loose material as the pick-up head moves along the ground surface;

a collection area behind the inlet area to hold the loose material collected from the ground surface; and material removing means to remove the loose material from the collection area;

wherein the pick-up head is pivotally mounted to the apparatus to allow the pick-up head to track the ground surface by tilting forward and backward and side-to-side in relation to a direction of travel of the apparatus.

2. The apparatus of claim 1, wherein the pick up head comprises a pair of forwardly extending outwardly diverging arm members adapted to slide along the ground as the apparatus moves, and which function to guide loose material towards the collection area.

3. The apparatus of claim 2, wherein the bottom wall of the pick up head comprises a bottom wall of the diverging arm members.

4. The apparatus of claim 3, wherein the inlet area comprises an inner side edge of each arm member and a forward part of a connecting web portion.

5. The apparatus of claim 4, wherein the material removing means is an auger which conveys loose material from the collection area to a dump bin.

6. The apparatus of claim 1, wherein the pick up head is pivotally mounted via a ball joint.

* * * * *